US007658668B2

(12) United States Patent
Hill

(10) Patent No.: US 7,658,668 B2
(45) Date of Patent: Feb. 9, 2010

(54) COIN HANDLING EQUIPMENT

(75) Inventor: Timothy William Hill, Shrewsbury (GB)

(73) Assignee: Scan Coin AB, Malmö (SE)

( * ) Notice: Subject to any disclaimer, the term of this patent is extended or adjusted under 35 U.S.C. 154(b) by 152 days.

(21) Appl. No.: 11/531,889

(22) Filed: Sep. 14, 2006

(65) Prior Publication Data

US 2007/0062783 A1 Mar. 22, 2007

Related U.S. Application Data

(60) Provisional application No. 60/785,697, filed on Mar. 24, 2006, provisional application No. 60/785,450, filed on Mar. 24, 2006, provisional application No. 60/720,974, filed on Sep. 27, 2005.

(30) Foreign Application Priority Data

Sep. 17, 2005 (GB) ..... 0519039.2
Mar. 3, 2006 (GB) ..... 0604289.9
Mar. 6, 2006 (GB) ..... 0604432.5

(51) Int. Cl.
*G07D 1/00* (2006.01)

(52) U.S. Cl. ..... 453/57; 453/29; 453/31; 453/59

(58) Field of Classification Search ..... 453/6, 453/7, 11–13, 30, 33–35, 49–54, 56, 57, 453/59

See application file for complete search history.

(56) References Cited

U.S. PATENT DOCUMENTS 76,492 A 4/1868 Meaker (Continued)

FOREIGN PATENT DOCUMENTS

CA 2299747 9/2001

(Continued)

OTHER PUBLICATIONS

International Preliminary Report on Patentability for PCT Application No. PCT/SE2004/001749, Filed Nov. 29, 2004.

(Continued)

*Primary Examiner*—Jeffrey A Shapiro
(74) *Attorney, Agent, or Firm*—Womble Carlyle Sandridge & Rice PLLC

(57) ABSTRACT

A hopper coin feeder (1) comprises upper and lower hopper discs (18, 25). A flexible hopper wall (17) of diabolo shape cooperates with the upper disc (18) to control the feeding of coins by a coin pushing member (35) to the outer margin of the disc (18) where they are gripped between an annular band (33) and the disc (18) to be conveyed past a coin discriminator (61). Any coins or debris that drop from the edge of upper disc (18) are caught on the lower disc (25) and pass to a reject chute (132) and coin payout cup (12). An active coin delivery chute and diverter (80), FIG. 10, comprises a reciprocable plate (81) having a finger (82) which controls whether a coin fed from the upper disc (18) passes down the chute or is rejected onto the lower disc (25). Coins that pass down the chute enter a bowl (89) of a double-disc coin conveying assembly (5) that conveys a coin from the bowl (89) to a LIFO coin stacks (3) of a coin storage unit (1). Oversize coins that enter the chute can be directed through the bowl (89), and through aligned apertures (8) in the coin conveying discs, to pass into a coin outlet (10) also leading to the payout cup (12).

26 Claims, 9 Drawing Sheets

U.S. PATENT DOCUMENTS 346,564 A 8/1886 Seegmueller
2,109,658 A 3/1938 Zicrick
2,863,464 A 12/1958 Hewitt et al.
3,038,157 A 6/1962 Simjian
3,131,702 A 5/1964 Buchholz et al.
3,731,695 A 5/1973 Meijer
3,970,992 A 7/1976 Boothroyd et al.
4,010,766 A 3/1977 Bowles et al.
4,108,518 A 8/1978 Angst
4,150,740 A 4/1979 Douno
4,286,703 A 9/1981 Schuller et al.
4,304,247 A 12/1981 Hasegawa
4,337,864 A 7/1982 McLean
4,403,900 A 9/1983 Thomas
4,412,550 A 11/1983 Watanabe et al.
4,558,712 A 12/1985 Sentoku et al.
4,564,037 A * 1/1986 Childers et al. ..... 453/6
4,632,621 A 12/1986 Cable
4,687,089 A 8/1987 Wuethrich
4,697,071 A 9/1987 Hiraoka et al.
4,733,765 A 3/1988 Watanabe
4,866,254 A 9/1989 Okayama et al.
4,897,984 A 2/1990 Sentoku et al.
4,943,257 A 7/1990 Nilsson et al.
4,946,341 A 8/1990 Parsley et al.
5,005,688 A 4/1991 Yukimoto et al.
5,030,165 A 7/1991 Nilsson et al.
5,064,074 A 11/1991 Edin et al.
5,067,928 A 11/1991 Harris
5,098,339 A 3/1992 Dabrowski
5,135,433 A 8/1992 Watanabe et al.
5,141,443 A 8/1992 Rasmussen et al.
5,240,099 A 8/1993 Brown et al.
5,295,899 A 3/1994 Adams et al.
5,316,517 A 5/1994 Chiba et al.
5,429,551 A 7/1995 Uecker et al.
5,480,348 A 1/1996 Mazur et al.
5,533,627 A 7/1996 Nordqvist
5,542,880 A 8/1996 Geib et al.
5,549,444 A 8/1996 Dubuit
5,560,467 A 10/1996 Takemoto et al.
5,564,974 A 10/1996 Mazur et al.
5,624,308 A 4/1997 Rumbach
5,628,258 A 5/1997 Zwahlen et al.
5,671,666 A 9/1997 Wenglar
5,680,935 A 10/1997 Mistander et al.
5,718,625 A 2/1998 Bointon
5,755,437 A 5/1998 Ek
5,813,510 A 9/1998 Rademacher
5,860,935 A 1/1999 Blaszynski et al.
5,864,826 A 1/1999 Awatsu et al.
5,873,446 A 2/1999 Wei
5,875,259 A 2/1999 Mennie et al.
5,918,748 A 7/1999 Clark et al.
5,923,413 A 7/1999 Laskowski
5,960,103 A 9/1999 Graves et al.
5,966,456 A 10/1999 Jones et al.
5,975,273 A 11/1999 Zwahlen et al.
5,997,395 A 12/1999 Geib et al.
6,003,652 A 12/1999 Murata et al.
6,006,989 A 12/1999 Ademmer et al.
6,030,284 A 2/2000 Frank
6,039,643 A 3/2000 Kurosawa et al.
6,047,886 A 4/2000 Saltsov
6,061,121 A 5/2000 Holl et al.
6,074,081 A 6/2000 Smith et al.
6,080,056 A 6/2000 Karlsson
6,082,616 A 7/2000 Lewis et al.
6,086,471 A 7/2000 Zimmermann
6,089,471 A 7/2000 Scholl
6,098,837 A 8/2000 Izawa et al.
6,101,266 A 8/2000 Laskowski et al.
6,109,522 A 8/2000 Force et al.
6,128,402 A 10/2000 Jones et al.
6,131,809 A 10/2000 Drescher et al.
6,135,291 A 10/2000 Canella
6,145,737 A 11/2000 Imai et al.
6,168,001 B1 1/2001 Davis
6,170,818 B1 1/2001 Eastman et al.
6,220,954 B1 4/2001 Nguyen et al.
6,237,739 B1 5/2001 Mazur et al.
6,241,244 B1 6/2001 Modi
6,289,261 B1 9/2001 Heidel et al.
6,290,050 B1 9/2001 Mikami et al.
6,290,070 B1 9/2001 Graef et al.
RE37,662 E 4/2002 Uchida et al.
6,371,473 B1 4/2002 Saltsov et al.
6,431,342 B1 8/2002 Schwartz
6,481,620 B1 11/2002 Katou et al.
6,499,277 B1 * 12/2002 Warner et al. ..... 53/447
6,502,746 B1 1/2003 Do et al.
6,640,956 B1 11/2003 Zwieg et al.
6,655,584 B1 12/2003 Lundblad
6,712,219 B2 3/2004 Kobayashi et al.
6,736,311 B2 5/2004 Hägglund et al.
6,758,316 B2 7/2004 Molbak
6,758,737 B2 7/2004 Svensson
6,766,892 B2 7/2004 Martin et al.
6,854,581 B2 2/2005 Molbak
2001/0004582 A1 6/2001 Umeda et al.
2002/0090906 A1 7/2002 Abe et al.
2003/0232588 A1 12/2003 Karlsson
2004/0029517 A1 2/2004 Perkitny
2004/0030622 A1 2/2004 Ramos et al.
2004/0200691 A1 * 10/2004 Geib et al. ..... 194/302

FOREIGN PATENT DOCUMENTS

DE 3315982 8/1988
DE 3821947 1/1989
DE 3250095 2/1995
DE 19811909 9/1999
EP 0 173 119 B1 3/1986
EP 0 450 918 A2 10/1991
EP 0 493 127 12/1991
EP 0 536 126 B2 4/1993
EP 0 409 809 B1 3/1994
EP 0 596 612 A3 11/1994
EP 0 700 553 B1 3/1996
EP 0 615 643 B1 7/1996
EP 0 803 844 A2 10/1997
EP 0 831 431 A2 3/1998
EP 0 841 641 A2 5/1998
EP 0 881 605 12/1998
EP 0 911 769 4/1999
EP 0 940 781 A1 9/1999
EP 0 682 326 B1 1/2000
EP 1 223 562 A1 6/2000
EP 1 020 818 A1 7/2000
EP 1 037 174 A1 9/2000
EP 1 130 551 9/2001
EP 0 795 842 B1 6/2002
EP 1 378 869 A2 1/2004
EP 1 391 850 A2 2/2004
EP 1 396 821 A1 3/2004
EP 1 388 821 B1 10/2006
EP 1 008 965 2/2007
FR 2 538 933 7/1984
FR 2838932 10/2003
GB 2 147 443 5/1985
GB 2 208 738 4/1989
GB 2 217 086 10/1989
GB 2 278 221 11/1994
GB 2 310 306 8/1997

| | | |
|---|---|---|
| GB | 2 327 795 | 2/1999 |
| GB | 2 335 775 | 9/1999 |
| GB | 2 369 228 | 5/2002 |
| JP | 62-114092 | 5/1987 |
| JP | 62-192469 | 7/1987 |
| JP | 62-209695 | 9/1987 |
| JP | 64-31286 | 2/1989 |
| JP | 04-205088 | 7/1992 |
| JP | 05-006475 | 1/1993 |
| JP | 08-335287 | 12/1996 |
| JP | 10-120006 | 5/1998 |
| JP | 2001-093019 | 4/2001 |
| JP | 2002-261461 | 9/2002 |
| SE | 504 813 | 4/1997 |
| SE | 511 607 | 10/1999 |
| SE | 520 989 | 9/2003 |
| SE | 521 635 | 11/2003 |
| WO | WO 90/09646 | 8/1990 |
| WO | WO 91/07734 | 5/1991 |
| WO | WO 92/11953 | 7/1992 |
| WO | WO 93/10511 | 5/1993 |
| WO | WO 95/13596 | 5/1995 |
| WO | WO 95/23387 | 8/1995 |
| WO | WO 96/36933 | 11/1996 |
| WO | WO 97/07485 | 2/1997 |
| WO | WO 97/25692 | 7/1997 |
| WO | WO 97/43739 | 11/1997 |
| WO | WO 99/05624 | 2/1999 |
| WO | WO 99/33030 | 7/1999 |
| WO | WO 00/31670 | 6/2000 |
| WO | WO 00/31694 | 6/2000 |
| WO | WO 00/31696 | 6/2000 |
| WO | WO 00/48137 | 8/2000 |
| WO | WO 00/67217 | 11/2000 |
| WO | WO 00/75766 | 12/2000 |
| WO | WO 01/04771 | 1/2001 |
| WO | WO 01/48705 | 7/2001 |
| WO | WO 01/62634 | 8/2001 |
| WO | WO 02/073548 | 9/2002 |
| WO | WO 02/082384 | 10/2002 |
| WO | WO 03/052700 | 6/2003 |
| WO | WO 2004/019285 | 3/2004 |
| WO | WO 2004/063065 | 7/2004 |
| WO | WO 2004/070668 | 8/2004 |
| WO | WO 2004/097754 | 11/2004 |

OTHER PUBLICATIONS

International Preliminary Report on Patentability for PCT Application No. PCT/GB2006/003435, Filed Sep. 15, 2006.

Written Opinion for PCT Application No. PCT/GB2006/003435, Filed Sep. 15, 2006.

Security Cash Register, IBM Technical Disclosure Bulletin, http://www.delphion.com/tdbs/tdb?o (1973).

Ascom Twin Safe advertising brochure, Oct. 1999.

Bankinfo.com publication, May 2, 2001.

Ascom Twin Safe advertising brochure.

IBM Technical Disclosure Bulletin vol. 15, No. 12, May 1973.

AST 9006, advertising brochure, 2001.

Cash Guard, advertising brochure.

* cited by examiner

COIN HANDLING EQUIPMENT

CROSS-REFERENCE TO RELATED APPLICATION

This application claims the benefit of British patent application no. 0519039.2, filed on Sep. 17, 2005; British patent application no. 0604289.9, filed on Mar. 3, 2006; British patent application no. 0604432.5, filed on Mar. 6, 2006; U.S. provisional patent application No. 60/785,697, filed on Mar. 24, 2006; U.S. provisional patent application No. 60/785,450, filed on Mar. 24, 2006; and U.S. provisional patent application No. 60/720,974, filed on Sep. 27, 2005.

INCORPORATION BY REFERENCE

The specification and drawings of British patent application no. 0519039.2, filed on Sep. 17, 2005; British patent application no. 0604289.9, filed on Mar. 3, 2006; British patent application no. 0604432.5, filed on Mar. 6, 2006; U.S. provisional patent application No. 60/785,697, filed on Mar. 24, 2006; U.S. provisional patent application No. 60/785,450, filed on Mar. 24, 2006; and U.S. provisional patent application No. 60/720,974, filed on Sep. 27, 2005, are incorporated herein in their entirety, by this reference.

FIELD OF THE INVENTION

This invention relates to coin handling equipment.

The term 'coin' is used herein to include any type of disc, such as a token, a counterfeit coin, a component of a composite coin, or a washer.

Various aspects of the invention relate to hopper coin feeders of the horizontal disc type, that is, of the type in which a coin feeding disc is substantially horizontal in use. The invention relates particularly, but not exclusively, to hopper coin feeders of the horizontal disc type into which, in use, a mixed batch of coins is put, either by hand or by an input device.

Other aspects of the invention relate to an active coin chute and diverter assembly suitable for use with such a hopper coin feeder, and to a coin storage assembly which is a development of that disclosed in patent specification WO 03/052700A, and which can be supplied with coins from a hopper coin feeder.

Yet further aspects of the invention relate to inventive combinations of at least two of the coin feeder, active coin chute, and coin storage assembly.

BACKGROUND TO THE INVENTION

An example of a hopper coin feeder of the horizontal disc type is that described in Patent Specification WO 99/33030 of Scan Coin AB. The coin feeder is part of a coin sorter, the SC Active 2200, which is a relatively bulky high speed machine for handling large quantities of coins in banks or cash centres, for example. The present invention stems from work to produce relatively compact coin handling equipment that can be used, for example, in a retail outlet in association with a till. Such equipment may operate at slower speeds than that of the SC2200 and accordingly this can involve smaller angular velocities of coins in the hopper.

When coins are input to a hopper coin feeder in a batch ideally the coins must be separated into a single layer so that they can be fed one by one to a coin discriminator. It is desirable for coins to be presented individually to the discriminator to allow them to be correctly sorted and/or counted. If the coins are not separated in this way it is possible for 'piggyback' coins (that is, one coin with one or more other coins riding on top of it) to make discrimination and/or counting of coins inaccurate.

It is known from WO 99/33030 for example, to provide a hopper comprising a stationary rigid cylindrical (or part-cylindrical) wall, which defines the principal coin-holding zone of the hopper and which has a stepped lower edge to define with the upper face of the horizontal disc a coin outlet gap from said zone, the gap being substantially the same height as the thickness of the thickest coin to be handled. When in use, the coins are carried by the rotating disc they tend to move outwardly under the influence of centrifugal force to impact the wall, and the stepped lower edge acts to scrape off the top layer of coins, only allowing coins with a thickness less than the height of the outlet gap to pass beneath the wall. Coins which can be fed by such a hopper feeder are obviously limited to those having a thickness which is less than the height of the outlet gap.

This arrangement is not completely satisfactory when feeding a mixed batch of coins, as not all coins are the same thickness. In a case where the combined thickness of two thin coins is less than the thickness of the thickest coin which can be fed through the outlet gap, it is possible for two thin coins to pass under the wall on top of each other. In addition to this, it is possible for two such piggyback coins to become jammed within the gap. Such a jam may be acceptable in a bank or cash centre setting, where the machine operatives are relatively skilled and are capable of quickly clearing the jam. It is not satisfactory, however, in a retail setting. In this situation a coin feeder is desired to be easy to operate and relatively fault free, as well as being capable of presenting a single layer of coins to a coin discriminator in order to allow the coins to be accurately counted and/or sorted.

SUMMARIES OF THE INVENTION

According to a first aspect of the invention we provide a hopper coin feeder of the horizontal disc type comprising a circular resilient hopper wall defining with a horizontal disc a hopper space for receiving coins and providing the principal coin holding zone of the hopper feeder, the disc and the hopper wall being arranged in use to rotate relative to a machine chassis, the resilient hopper wall having a lower edge which is closely adjacent to, or in contact with, the upper face of the horizontal disc when the hopper wall is not flexed, and a stationary coin pushing member extending generally radially inwardly from adjacent the edge of the horizontal disc, beneath said lower edge into said hopper space, the hopper coin feeder being so arranged that, in use, a coin input to the hopper space is carried on the rotating horizontal disc, and on contact with the coin pushing member is urged radially outwardly beneath the lower edge of the resilient hopper wall, the hopper wall flexing in order to allow the coin to pass.

When a coin is pushed under the resilient hopper wall the lower edge of the hopper wall 'wipes' away any further coins that may be resting on top of the coin, ensuring they remain in the hopper space.

The resilient hopper wall is preferably arranged to be sufficiently flexible that in the rare event that two piggyback coins are pushed under the resilient wall at the same time, the wall will allow both coins to pass, rather than jam.

Preferably the hopper wall comprises frusto-conical upper and lower parts, the lower part expanding downwardly, so as to define an angle with the horizontal disc that is less than 90 degrees, as viewed internally of the hopper. This reduces the possibility that piggyback coins might be pushed under the wall, as the outer edge of the upper coin will be positioned radially inwardly (relative to the disc axis) of the outer edge of the lower coin, by engagement of the coins with said lower part of the hopper wall, so that the coins are not presented to the lower edge of the hopper wall at the same time.

Preferably the coin pushing member is no thicker than the height of the minimum specified thickness of coins to be input to the hopper.

Most preferably the coin pushing member is of a height less than the thickness of the thinnest coin specified to be input to the hopper. This will usually prevent the coin pushing member from pushing more than one coin under the resilient hopper wall at one time. A coin that is resting on top of a lower coin is wiped over the coin pushing member by the resilient hopper wall as the lower coin is pushed by the coin pushing member beneath the lower edge of the hopper wall.

Preferably the coin pushing member is arcuate in plan, and defines a curve which is substantially convex as presented to the approaching coins on the disc. Most preferably the coin pushing member extends substantially to the centre of the disc, in order to encounter all coins that have been deposited into the hopper space.

A radially inner portion of the coin pushing member is preferably covered by a faired cap.

The frusto-conical upper part of the resilient hopper wall preferably expands upwardly so as to define a rim around the hopper space. This arrangement creates a bowl-like hopper upper space into which coins can be input. The hopper wall is thus in the form of a diabolo or concertina, and so can deform upwardly under pressure as well as radially outwardly at its lower edge.

In the coin sorter of WO 99/33030 the coins which pass through the open outlet opening 23 defined between the stepped lower edge of the rigid annular wall 2 and the face of the disc 1 are then urged radially outwards by a coin pushing member in the form of a knife 4 to force the coins under an annular resilient band, (rim 14 of rotating ring 3), to cause the coins fed through the gap 23 l to be gripped at one edge of the coin between the resilient band 14 and the radially outer margin of the disc. The gripped coins are then carried round with the disc past a coin discriminator and then to various stations where the coins are ejected from the disc by selective operation of deflector units 17 by respective solenoids 16, in response to the output of the coin discriminator. Because the coins are held by only one edge, the coin discriminator is able to make a thorough inspection of the coins.

Preferably a hopper coin feeder in accordance with the first aspect of the present invention also comprises a resilient band that is closely adjacent to the margin of the upper face of the disc and is driven round with the disc, the arrangement being such that coins fed to the band by said coin pushing member are then carried round with the disc, but projecting from the band, in a similar manner to that of WO 99/33030.

In a preferred arrangement of the present invention separate stepper motors are provided for the disc and band, but driven in synchronism by a common pulse source. This has the advantage that the top portion of the hopper feeder may be opened up without the need for disengaging a mechanical drive connection between the disc and the band.

In the coin sorter of WO 99/33030 the coin pushing blade 4 is readily supported on the rigid hopper wall 2, but in a construction in accordance with the first aspect of the present invention which utilises a rotating resilient hopper wall, this is not possible.

If no support is provided for the end of the coin pushing member that is remote from the hub, the coin pushing member can flex or deflect when a coin is pushed by the coin pushing member beneath the hopper wall and/or the resilient band.

We consider it to be desirable to secure relative to the chassis that part of the coin pushing member which is remote from the hub. For simplicity of manufacture the remote end of the coin pushing member may be supported from a point radially outwards of the edge of the horizontal disc, using a support plate extending locally beneath the band.

However, supporting the coin pushing member in that way creates a further problem, since the coin conveying band must necessarily run over the support plate. This undesirably creates excessive wear on the belt, and significant frictional force to be overcome by the band drive, because in order to grip the coins between the band and the disc, the band is arranged to be stiffer than the lower margin of the hopper wall, even when made of the same material.

We prefer to provide a band deflecting bearing located where the support plate extends beneath the band, the bearing being adapted in use to deflect the band in such a way that the band substantially does not press directly against the support plate.

The band deflecting bearing is preferably located above the support plate.

The band deflecting bearing is preferably a wheel rotatably mounted above the support plate. Most preferably the belt deflecting wheel is substantially frusto-conical, with the base of the frustum being adjacent the support plate, and so arranged that the band is locally flared by the wheel to deflect the lower margin of the band upwardly and radially outwardly, relative to the disc axis, over the support plate.

The axis of rotation of the wheel is preferably located radially inwardly, relative to the disc axis, of a centre line of the band.

The support plate is preferably provided with a coin take-off edge that is so configured as to engage in turn coins gripped between the band and the disc, and which takes off those coins from the disc.

Most preferably the coin band and the resilient hopper wall are moulded as a single piece, which may be over-moulded onto a rigid carrier ring.

The coin take-off face of the support plate is conveniently spaced circumferentially of the disc path from the outer end of the coin pushing member in order to accommodate a coin discriminator which examines the coins as they are carried past the discriminator with one edge of the coin gripped between the band and the outer margin of the disc.

An arcuate guide block is preferably secured to the radially outer end of the coin pushing member and to the radially inner part of the support plate, the radially outer face of the guide block providing a guide face for the gripped edges of the coins.

The support plate and the coin pushing member may be formed integrally from sheet material, with the arcuate guide block being attached thereto.

In order to provide rigid support by the support plate for the pushing member and for the arcuate guide block, the support plate may have two circumferentially-spaced limbs that extend beneath the band, both limbs supporting respective band deflecting bearings.

On occasion it is possible that an item, such as an oversize coin or a foreign body, may be driven by the coin pushing member so as to topple over the edge of the coin disc.

In order to collect any such falling item the coin feeder preferably comprises an additional rotatable horizontal disc positioned below the main disc.

Conveniently, the upper disc and the lower disc are connected together by a hub for driving with a common drive motor, and the lower disc is surrounded by a bowl wall to deflect any falling items onto the lower disc.

Suitable lower disc take-off means are preferably provided for returning items received on the lower disc to a pay-out cup for return to the customer.

According to a second aspect of the invention we provide a coin hopper feeder of the horizontal disc type and comprising upper and lower horizontal rotatable discs mounted about a common axis of rotation, a hopper wall defining with the upper disc a hopper space for receiving coins and providing the principal coin holding zone of the hopper feeder, a resilient band closely adjacent to the margin of the upper face of the upper disc, means for feeding coins from said hopper space and to push them in turn beneath the resilient band so that they are carried round by the upper disc, gripped between the band and the upper disc and projecting radially outwards of the band, past a coin discriminator, the arrangement being such that any coins that should fall from the edge of the upper disc are directed onto the lower disc, respective coin take off means for removing coins respectively from the upper and lower discs, a coin diverter assembly for receiving coins from the take off means of the upper disc and arranged to feed accepted coins to a first coin outlet, and to divert rejected coins onto the lower disc according to the measurements made by the coin discriminator, whereby rejected coins and coins that have fallen from the upper disc are directed to a second, reject coin outlet.

Preferred embodiments of the inventive hopper coin feeder have been developed for use in conjunction with a double-disc coin delivery assembly based upon that disclosed in PCT patent application No. WO 03/052700, as will be discussed hereafter.

A novel coin chute and diverter unit has been developed with that purpose in mind.

A third aspect of the present invention relates to a coin chute and diverter unit adapted to receive coins fed thereto in a substantially horizontal orientation and in single file, and to divert an unwanted coin so as not to enter the chute, in dependence upon a measurement made on the coin, preferably by a non-contact coin measuring device.

The term 'measurement' as used herein is intended to include comparison with a reference value that may have been obtained from tests on a coin.

According to the third aspect of the invention a coin chute and diverter unit is adapted to receive coins fed thereto in a substantially horizontal orientation in single file along a coin path, an upper wall of the chute comprising a reciprocable plate in the form of a curved finger, as viewed in vertical cross-section transverse to said coin path, with the tip of the finger being directed towards the oncoming coin feed, plate reciprocation means adapted to move the plate generally upwards and downwards between a raised coin diverting position, and a lowered coin accepting position, the arrangement being such that in the raised coin diverting position a coin of a predetermined maximum thickness fed towards the upper end of the chute passes beneath the finger tip to engage with the underside of the finger so as to be prevented from entering the chute and to be deflected downwardly external to the chute, and when the plate is in the coin accepting position a coin fed towards the chute passes over the tip of the plate and slides into the chute.

Thus the plate when raised acts to deflect coins out of the coin path for rejection, or recirculation, but when lowered allows a coin to enter the upper part of the chute.

The plate reciprocation means preferably comprises a solenoid and return spring.

The plate preferably defines a substantially flat chute base, which is inclined at an acute angle to the vertical, and the plate reciprocation means is preferably arranged to reciprocate the plate substantially in the longitudinal direction of the chute base.

In order to arrest any oversize coins, or other unwanted large items that should enter the upper part of the chute, an article thickness gauge is preferably provided which confronts the chute base to define therewith a restriction.

The thickness gauge is preferably in the form of a pivoted restrictor with the pivot spaced from the chute base, the arrangement being such that when the restrictor is pivoted away from the chute base, a trapped article is then able to fall down the chute.

A curved guide surface is preferably provided at the lower end of the chute so arranged as to direct a coin sliding down the chute into a horizontal orientation, and a snubber is preferably provided in a position opposing the curved guide surface, and so arranged as to arrest a coin that has slid down the chute and said guide surface.

According to a fourth aspect of the invention, a coin chute and diverter unit in accordance with the third aspect of the invention is coupled to a hopper coin feeder of the horizontal disc type, that is of the type in which a coin feeding disc is substantially horizontal in use and the feeder is adapted to feed coins deposited on the disc to one or more coin outlets.

When such a hopper feeder is provided with a suitable coin take-off means, such as a coin deflector blade, mixed coins can be caused to exit the disc in single file in a horizontal orientation, and in accordance with the invention the coin chute and diverter unit are positioned to receive the single file flow of coins from the coin take-off means.

The hopper coin feeder preferably comprises an annular band of flexible material positioned above the disc and adjacent to the radially outer margin of the upper face of the disc to carry coins gripped between the band and the disc to the coin take-off means.

Said coin measurement means is preferably positioned adjacent to the margin of the disc in advance of the coin take-off means to measure the characteristics of a coin being carried round by the disc and band towards the take-off means.

The disc is preferably arranged to be driven by a stepper motor, and stepper motor control means may be provided which is so configured as to hold a gripped coin just prior to the take-off means, in readiness for feeding to the chute and diverter unit when there is a demand for a coin to be delivered by the chute.

The chute can provide a relatively short path between the point at which the coin is held, and the apparatus connected to the chute for handling the delivered coin, thereby helping to increase the overall speed of operation of the coin feed.

In accordance with a fifth aspect of the invention a coin chute and diverter unit in accordance with the third aspect of the invention is coupled to a double disc coin feeder assembly which comprises upper and lower superimposed adjacent discs which are each provided with a respective coin-carrying opening, the discs being independently rotatable and capable of being brought into a relative orientation in which the coin-carrying openings in the upper and lower discs are in register to permit transfer of a coin from one opening to the other opening, the base of the chute leading to a bowl, the base of which is formed by an exposed portion of the upper surface of the upper disc, the upper disc being capable of being rotated to a coin-receiving position in which the opening in the upper disc is exposed to the bowl for receiving a coin from the chute.

As described in patent specification No. WO 03/052700A, with particular reference to FIG. 4 thereof, a double disc coin feeder assembly can be used to convey coins fed thereto to a selected one of a plurality of coin stack tubes.

In the preferred arrangement described in WO'700A the upper disc is employed to separate coins from a batch of coins inserted, for example by a customer in a retail outlet, into a hopper, whereas in accordance with the fourth aspect of the present invention coins can be fed singly to said bowl and can then be received in the opening of the upper disc when the upper disc is turned to bring the upper disc opening into position in the bowl.

Control means is preferably provided for an actuator connected to said pivotable restrictor and for motors driving the upper and lower discs, the control means being so configured as to bring the discs to positions in which the openings in the upper and lower discs are in register and exposed to the bowl interior, when it is desired to release an oversize coin or large item that has been trapped by said restrictor, thereby permitting the oversize coin or large item to fall through the aligned openings in the discs and pass to an outlet or a container.

The lower part of the chute, below the restrictor, may have associated therewith a coin sensor to detect the passage of, or freeing, of a coin trapped by the flap.

Instead of utilising a coin chute and diverter unit in accordance with the fifth aspect of the invention, it is envisaged that, in accordance with a sixth aspect of the present invention said bowl is fed with coins one at a time from a coin acceptor unit of the kind that is commonly used in vending machines and which receives coins fed into it one by one by the user.

Preferably any oversize coins accepted by the acceptor unit can be released from a pivotable restrictor, as previously described, into the bowl for return to the customer by way of aligned openings in the upper and lower discs, and pass to the outlet or a container.

According to a seventh aspect of the invention we provide a combination of a hopper coin feeder and a coin storage unit, the hopper coin feeder being of the horizontal disc type and being adapted to feed coins inserted into the hopper in single file towards a coin outlet, a coin chute leading from said coin outlet to a bowl, the coin storage unit comprising a plurality of LIFO (last in, first out) coin stack tubes fed by a double disc coin feeder assembly which comprises upper and lower superimposed adjacent discs each provided with a respective coin-receiving opening, the discs being independently rotatable and capable of being brought into a relative orientation in which the coin-receiving openings in the upper and lower discs are in register to permit transfer of a coin from one opening to the other opening, the base of said bowl being open to an exposed portion of the upper surface of the upper disc, the upper disc being capable of being rotated to a coin receiving position in which the opening in the upper disc is exposed to the bowl for receiving a coin from the chute, and a control system for the hopper coin feeder and the coin storage unit so arranged as to hold the disc with a coin on the disc just in advance of said coin feeder outlet, and in response to a coin demand signal from the coin storage unit, to drive the hopper disc to dispense the coin into the coin chute for delivery to the bowl.

In developments of the coin storage unit described in WO 03/052700A, with particular reference to FIG. 4 thereof, we have found that there are significant advantages in arranging for the coin inlet station of the double disc feeder assembly to be used also as the coin payout station.

According to an eighth aspect of the invention we provide the combination of a coin feeder and a coin storage unit, the coin feeder being adapted to feed coins to a bowl, the coin storage unit comprising a plurality of LIFO (last in, first out) coin stack tubes fed by a double disc coin conveying assembly which comprises upper and lower superimposed adjacent discs each provided with a respective coin-receiving opening, the discs being independently rotatable and capable of being brought into a relative orientation in which the coin-receiving openings in the upper and lower discs are in register to permit transfer of a coin from one opening to the other opening, the base of said bowl being open to an exposed portion of the upper surface of the upper disc, the upper disc being capable of being rotated to a coin receiving position in which the opening in the upper disc is exposed to the bowl for receiving a coin from the coin feeder, and then being rotated to convey the coin to one of the stack tubes, a coin outlet from the coin storage unit extending from beneath the bowl thereby enabling an unwanted coin coming from the coin feeder to pass from the bowl, through the aligned openings in the double disc coin conveying assembly, when said upper and lower discs are positioned with their respective openings in register with said bowl, to pass into the coin outlet.

A hopper coin feeder in accordance with the invention, and the combination in accordance with the invention of that feeder with a coin storage unit to store and dispense coins for use in a retail outlet, will now be described, by way of example only, with reference to the accompanying drawings.

BRIEF DESCRIPTION OF THE DRAWINGS

In the accompanying drawings:

With reference to FIG. 1 there is shown the combination of a hopper coin feeder assembly 1 and a coin storage unit 2 suitable for use in a retail outlet in association with a till. The coin storage unit 2 is essentially that described in Patent Specification No. WO 03/052700A, with particular reference to FIG. 4 thereof, but with some detailed changes to the coin outlet.

Figure 1:
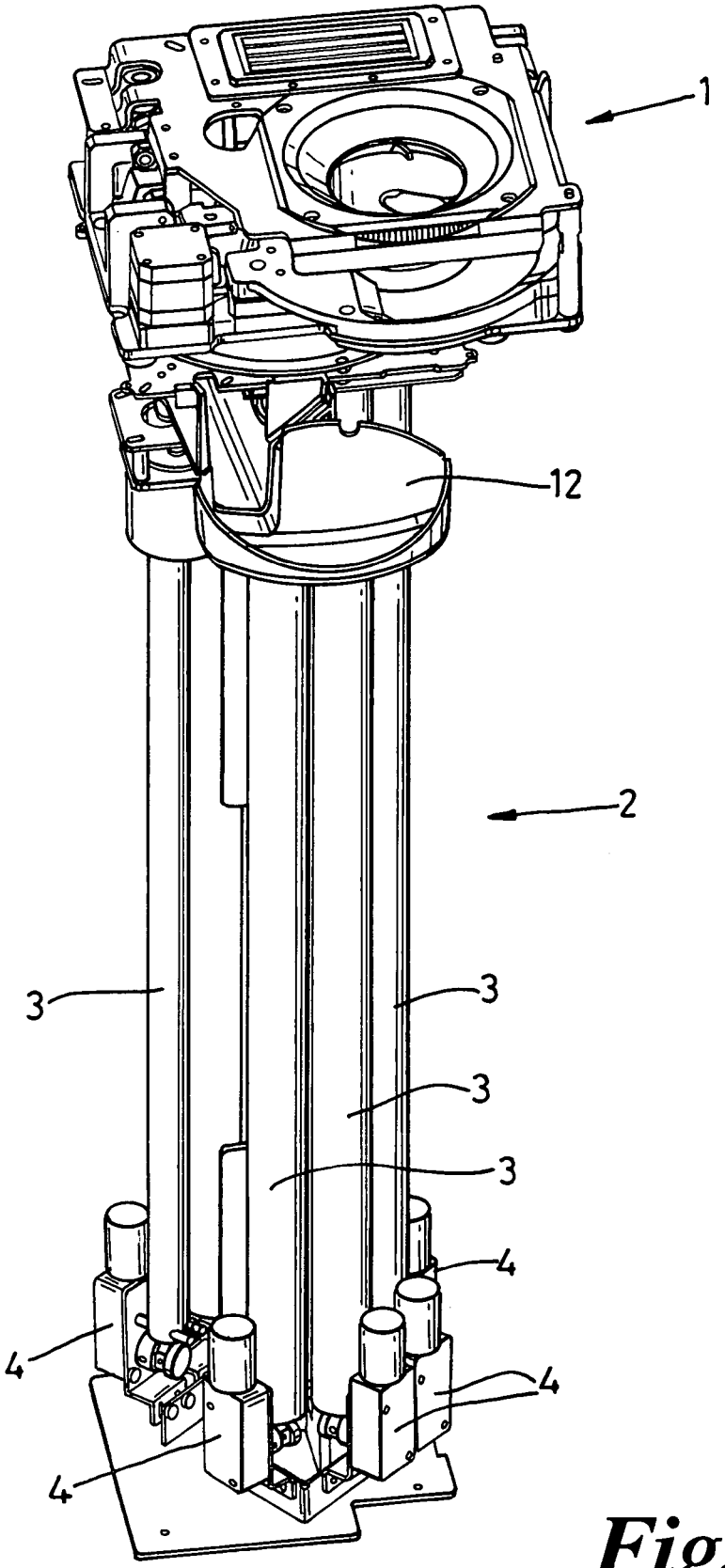
FIG. 1 is a perspective view of the hopper coin feeder and a coin storage unit which comprises a series of motorised coin stack tubes, the hopper coin feeder being shown slightly raised from its assembled position on the coin storage unit.

Coin storage unit 2 comprises a plurality of coin stack tubes 3 arranged in a circular array, as viewed in plan. Each coin stack tube 3 acts as a LIFO (last in, first out) coin holder for a particular denomination of coin assigned to that stack tube. Each stack tube houses a coin stack supporting plunger that is spring-biased in the upward direction but is pulled downwards to a desired position by a respective tape driven by a respective tape drive motor 4. Thus, operation of one of the tape drive motors 4 can raise or lower the stack of coins as desired to permit removal of a coin from the top of the respective stack tube 3, or loading of a coin into the top of that stack tube.

Figure 2:
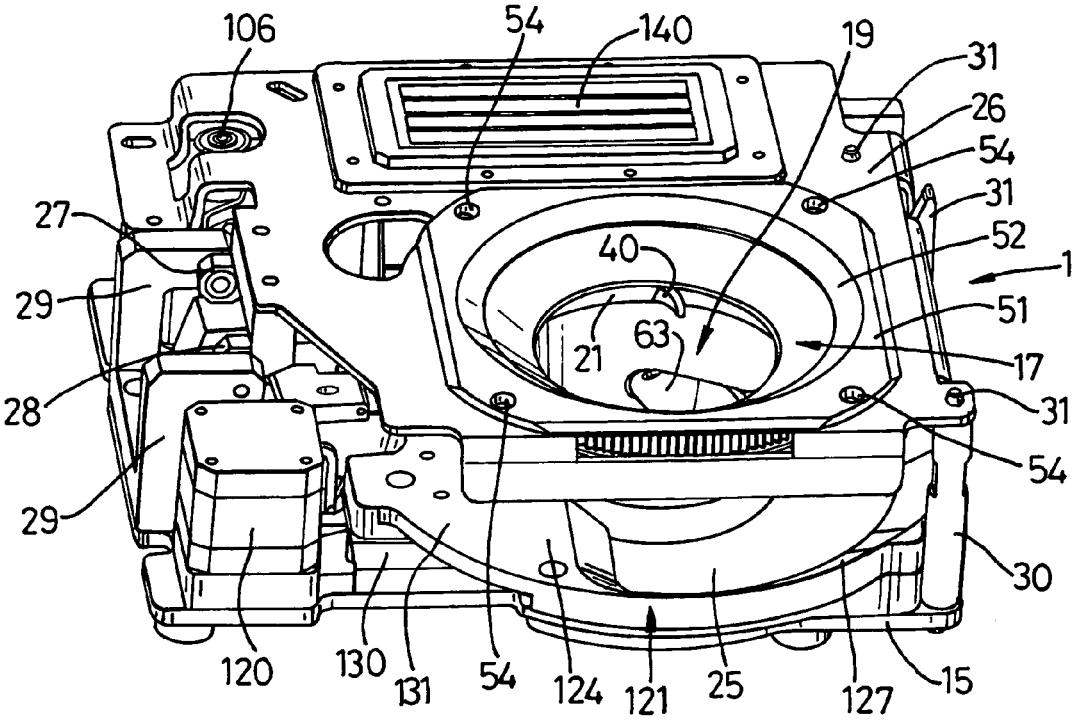
FIG. 2 shows on a larger scale the hopper coin feeder detached and raised vertically from the coin storage unit, the two superimposed adjacent coin delivery discs of the storage unit being shown in the positions in which the respective openings in the delivery discs are in register with each other and with an underlying coin delivery opening leading via a coin dispensing chute to a coin pay-out cup.
Figure 2:
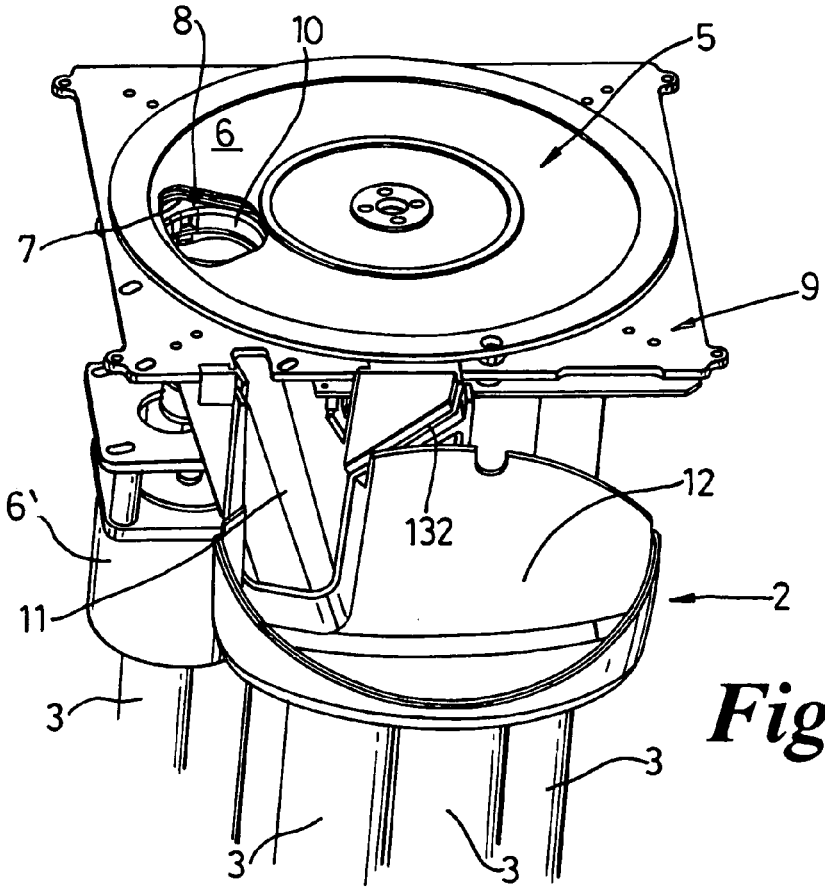

A delivery disc assembly 5, FIG. 2, carries coins to and from tops of the various stack tubes 3. The delivery disc assembly 5 comprises superimposed adjacent coin sorter discs 6, 7, seen in section in the lower part of FIGS. 9, 10 and 11. Each disc 6, 7 contains at least one opening 8 which is big enough to receive the largest coin that is capable of being stored in one of the stack tubes 3.

The coin delivery discs 6, 7 are independently indexable by respective drive motors, one of which is shown in FIG. 2 at $6^1$.

The lower coin delivery disc 7 in effect operates as an indexable shutter to determine whether or not a coin located in the opening 8 of the upper disc 6 can fall through the opening 8 in the lower disc 7 or is supported on the upper face of the lower disc. Thus, upper disc 6 can carry a coin to and from a particular stack tube by indexing of the upper disc 6, whilst it is ensured that the opening 8 in the lower disc is not in register with the opening 8 in the upper disc.

As shown in FIG. 2, the discs 6, 7 of delivery disc assembly 5 are rotatably mounted on a platform 9 which is provided with a circular dispensing aperture 10 leading to the upper end of a dispensing chute 11 which terminates in coin pay-out cup 12. The coin pay-out cup 12 is accessible to the user through a suitable opening provided in the front wall of a compact casing, not shown, which houses the coin feeder assembly 1, and coin storage unit 2. Alternatively the coin feeder 1 and coin storage unit 2 could be mounted under a retail outlet counter, and the pay-out cup 12 could be accessible through an aperture in the front wall of the counter, or project therefrom.

The dimensions and configuration of the dispensing chute 11 are such that a child cannot insert his or her fingers so as to reach the discs 6, 7.

The hopper coin feeder assembly 1 has been designed as a particularly compact unit for controllably feeding the coin delivery disc assembly 5 of the coin storage unit 2 with coins one at a time, from a batch of coins inserted into the hopper of the coin feeder by a customer, to enable the delivery disc assembly 5 to accept a coin and then to a carry that coin for loading into the appropriate stack tube 3, and then to return to receive the next coin being fed from coin feeder assembly 1.

We consider that it is desirable, particularly for use in a retail outlet, that the payout cup 12 should not be far removed from the entrance to the hopper into which the customer places the coins for a transaction.

This resulted in a design aim to try to keep the height of the hopper feeder assembly 1 substantially to a minimum.

In addition we considered it desirable that the overall plan outline of the hopper feeder assembly 1 should be comparable in dimensions with the plan outline of the coin storage unit 2, and this necessitated the use of a relatively small hopper disc. The use of a small hopper disc, as compared with hopper discs of coin sorters such as the SC Active 2200, presented new challenges in how to handle a batch of coins fed into the hopper and to feed all of the coins from the hopper. One reason for the difficulties presented is that the diameters of the individual coins are a relatively larger fraction of the radial dimensions of the horizontal coin disc, so that different geometrical considerations arise. Another reason is that in general the disc speed will be less than that of the SC Active 2200, and so centrifugal forces are less.

Referring to FIGS. 2 to 7 the hopper coin feeder assembly 1 comprises a chassis 15 supporting a fixed vertical post 20 on which is journalled a bowl-shaped hub 24. Vertically spaced-apart upper and lower horizontal steel discs 18 and 25 respectively are secured to the hub 24 for rotation therewith, the upper disc 18 having a diameter of 136 mm. The discs 18, 25 are driven by a stepper motor 120 mounted on chassis 15, by means of a timing belt, not shown, engaged with a toothed drive ring 121, FIG. 7, secured to hub 24.

The chassis 15 supports an apertured generally horizontal, pressed-metal hopper-bearing support plate 26 by way of a pair of hinges 27, 28 connected to a pair of rectangular pillars 29 on one end of the chassis and by a pair of tubular pillars 30 at the other end of the chassis, the pillars 30 each carrying an upwardly directed locating spigot 31 received in a respective locating hole in the bearing support plate 26. The support plate 26 is normally held in a horizontal position firmly engaged with the pillars 30 by a spring-biased latch 31, but on release of the latch 31 can be swung upwards to allow access to the upper disc 18 for cleaning, for example when a drink has been allowed to flow into the hopper.

An annular, resilient hopper wall 17 is rotatably supported with respect to the hopper-bearing support plate 26 by a bearing assembly 32.

The hopper wall 17 comprises a lower annular wall portion 21, which is frusto-conical, expanding in the direction towards the disc 18, to define an acute angle with the upper face of the disc 18. An upper part 22 of the wall 17 is frusto-conical, expanding in the direction away from the disc 18, and defines a rim $19^1$ to the hopper space 19. The upper part of the hopper space 19 therefore constitutes a bowl, into which a user may place a batch of coins.

The upper and lower parts 22, 23 of the hopper wall 17 are conveniently parts of an integral moulding so that in section the wall 17 is seen to form a diabolo or concertina shape. The upper and lower parts of the wall 17 are resilient, allowing the lower edge 23 of wall 17 to flex upwardly and/or outwardly in order to allow a coin to be mechanically pushed beneath lower edge 23. When the wall is not flexed by a coin the lower edge 23 lies slightly spaced from the upper face of the upper horizontal disc 18.

Spaced radially outwardly of the lower edge 23 of the wall 17 is a resilient band 33 which is in contact with the upper disc 18 near outer rim thereof. The band 33 is arranged in use to grip coins between the lower edge of band 33 and the upper disc 18 in such a way that the majority of a gripped coin overhangs the disc 18. Such a method of conveying coins is more fully described in the aforementioned PCT specification number WO 99/33030.

The resilient hopper wall 17 and band 33 are formed as on integral moulding that has been overmoulded onto an annular rigid perforated carrier ring 42. Ring 42 is secured to an annular drive ring 43 journalled on a bearing 32, drive ring 43 being provided with external teeth 44 engaged by the drive belt 45 from motor 46.

Motors 46 and 120 are driven in synchronism by a common pulse source.

A suitable material of the moulding of the hopper wall and band is a polyurethane having a hardness of about 60 ShoreA and with minimum deflection set.

Figure 6:
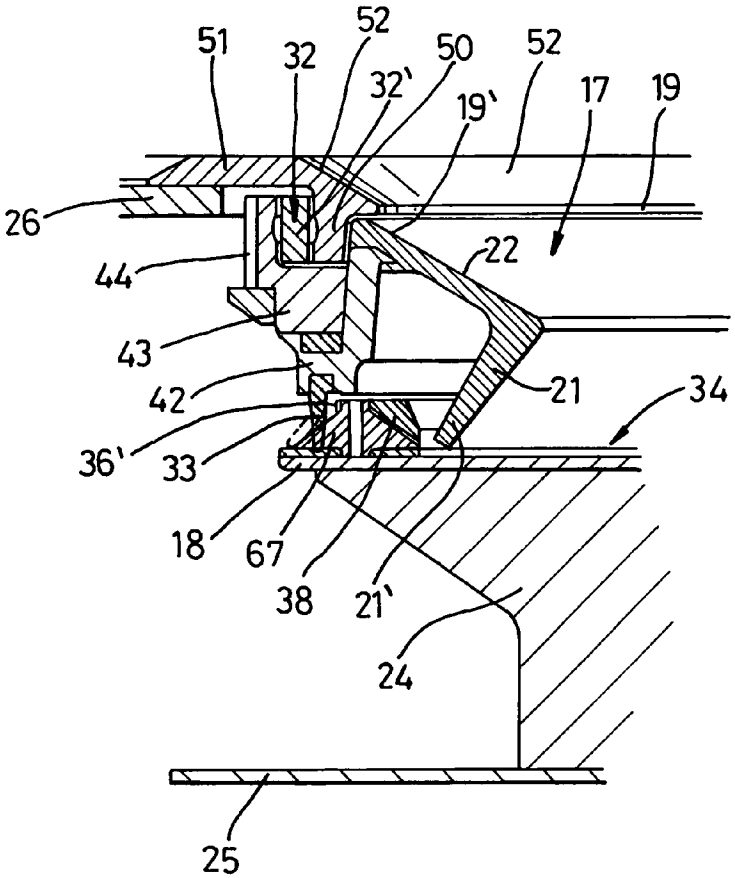
FIG. 6 is an enlarged cross-sectional partial view taken on the line 6-6 of FIG. 4, the resilient band being shown in full outline in the relaxed position (prior to encountering the frusto-conical bearing) and in broken outline in the deflected condition as it passes over the bearing.

The bearing 32 comprises an annular cage 32$^1$ for balls, not shown, confined between the drive ring 43, which constitutes the rotating outer member of the bearing 32, and a stationary bearing inner ring 50 integrally depending from a horizontal bearing mounting plate 51 provided with a frusto-conical guide face 52 which slightly overhangs the rim 19$^1$ of the rotating hopper wall 17, as shown in FIG. 6, to guide any coins into the hopper that have been deposited by the user into the marginal part of the hopper opening 19. A suitable material for the drive ring 43 and bearing mounting plate 51 is acetyl.

Bearing mounting plate 51 is substantially square in plan but with rounded corners, and is secured in face contact with the hopper bearing support plate 26 by four screws, not shown, in holes 54, FIG. 2, the support plate 26 being formed with a circular opening to receive with clearance the rotating drive ring 43.

A horizontal, flat coin pushing member 34 in the form of a blade, of a thickness that is equal to or less than that of the thinnest coin that is to be handled, is fixedly secured at its radially inner end 34$^1$ to the top of post 20 and comprises a first arcuate portion 35, which extends from the post 20 beneath the lower edge 23 of the wall 31 to a position just radially inward of the band 33. The first arcuate portion 35 is contiguous with a second arcuate portion 36, which provides a datum 36$^1$ which extends at a substantially constant radial distance from the post 20, from the first portion 35 in the direction of rotation of the disc to an integral coin pushing member support plate 37. An arcuate guide block 38 of substantially rectangular cross-section is attached to the arcuate portion 36 of the coin pushing member 34 in registry therewith to increase the height of the arcuate datum wall 36$^1$ which guides the gripped inner edges of the coins being conveyed with the disc 18. The guide block 38 extends circumferentially beyond the support plate 37 as a tail 38$^1$, the radially inner face 38$^{11}$ of which helps to feed towards the member 34 any coins that occasionally get pressed beneath the extremity 21$^1$ of the hopper wall portion 21 due to jostling of a large number of coins on the upper disc 18.

The operation of the hopper coin feeder 1 in use will now be further described with reference to FIG. 4. The discs 18, 25 rotate relative to the chassis in the direction indicated by arrows 60. The band 33 also rotates in the same direction and at the same speed.

A mixed batch of coins is introduced into the hopper space 19 and the coins are caused to rotate by the motion of the upper disc 18 and by means of vanes 40 provided integrally on the lower wall portion 21. The coins that are driven by the disc 18 naturally move radially outwardly under the influence of centrifugal force. However, centrifugal force in itself is not sufficient in general to push the coins underneath the lower edge 23 of the hopper wall 21 (except, as previously mentioned, when there is congestion on the disc of a lot of coins). Thus a coin 55*f*, FIG. 4, is generally retained within the hopper space until it contacts the coin pushing member 34.

As the rotational motion of the upper disc 18 carries the coins into contact with the stationary coin pushing member 34, the member 34 acts as a barrier to those coins in face contact with the disc 18, and pushes the coin radially outwardly. The first arcuate portion 35 of the coin pushing member 34 forces the coin 55*a, c* beneath the hopper wall 21, the lower part of which flexes in the direction of arrow 41 (as is shown in more detail in FIG. 8) in order to allow the coin to pass under the extremity 211 of the hopper wall portion 21. The coin is pushed outwardly until it reaches the second arcuate portion 36 of the member 34. A coin 55*d* is shown in FIG. 4 abutting datum 36$^1$, and is gripped between the band 33 and the upper surface of the upper disc 18 and will then be conveyed by the rotation of the band 33 and the disc 18 in the direction shown by arrows 60.

Figure 8:
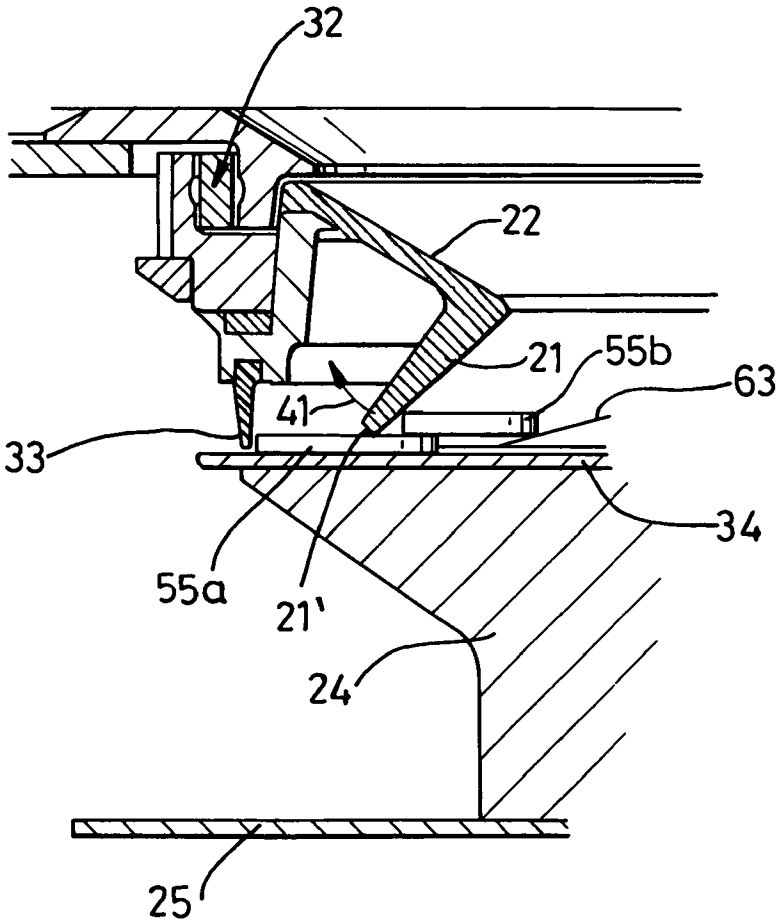
FIG. 8 is an enlarged cross-sectional partial view, similar to FIG. 6, but taken on the line 8-8 of FIG. 4, and showing how the frusto-conical lower wall of the hopper wipes away a piggy-back coin.

In the case of piggyback coins 55*a ,b*, the lowermost coin 55*a* is pushed into the wall lower portion 21 by coin pushing member 34, and the upper coin 35*b* is also carried against the lower wall portion 21 by the motion of the lower coin 55*a*. While the lower coin 55*a* is pushed under the lower edge 21$^1$ of the resilient wall 21, the upper coin 55*b* impacts the wall portion 21 at a point above and radially inward of the lower edge 21$^1$. The thickness of the coin pushing member 34 is chosen to be less than the height of a single coin, and so the upper coin 55*b* is not pushed under the wall by the member 34, but is instead pushed over the member 34 by the wall, as shown in FIG. 8, and remains in the hopper space while the lower coin 55*a* is pushed under the wall portion 21. A faired cap 63, FIG. 4, on the radially inner end of the coin pushing member 34 helps to urge the upper coin 55*b* to pass over the coin pushing member 34.

In the unlikely event that the coin pushing member 34 pushes two piggyback coins under the wall portion 21, the hopper wall 17 is sufficiently flexible to allow both coins to pass without the hopper feeder jamming. These two coins will then be subsequently identified by a discriminator module 61 for subsequent rejection.

An advantage of the illustrated hopper coin feeder is that it can made relatively compact. In particular the overall vertical height of the feeder can be kept to a minimum.

A coin 55*d* gripped between the band 33 and the disc 18 is conveyed through a discriminator module 61 of calliper shape which identifies and validates the coin. Based on the output of the discriminator 61 the coin may be selected for rejection. The advantage of gripping one edge of the coin 55*d* and passing it, as at 55*e*, through the discriminator module 61 is that the discriminator module 61 may, if desired, be arranged to inspect the surface characteristics of both sides of the coin.

The lower edge of the band 33, when undeflected, is in close proximity with the upper surface of the horizontal disc 18. In order for a coin to be gripped between the band 33 and the disc 18, the band 33 should not be spaced from the disc 18 by a distance that is more than the thickness of the smallest coin that is intended to be input into the hopper space for handling by the coin storage unit 2.

As previously discussed, the coin pushing member 34 in conjunction with the arcuate block 38 provides a datum 36$^1$, just radially inward, relative to the disc axis, of the centre line 65 of the band 33, in order to provide a guide for coins gripped by the band 33 as the coins are conveyed around the edge of the disc 18. The coin pushing member support plate 37 provides support for the member 34 and block 38 as coins are pushed beneath the lower hopper wall portion 21 and the band 33.

Figure 4:
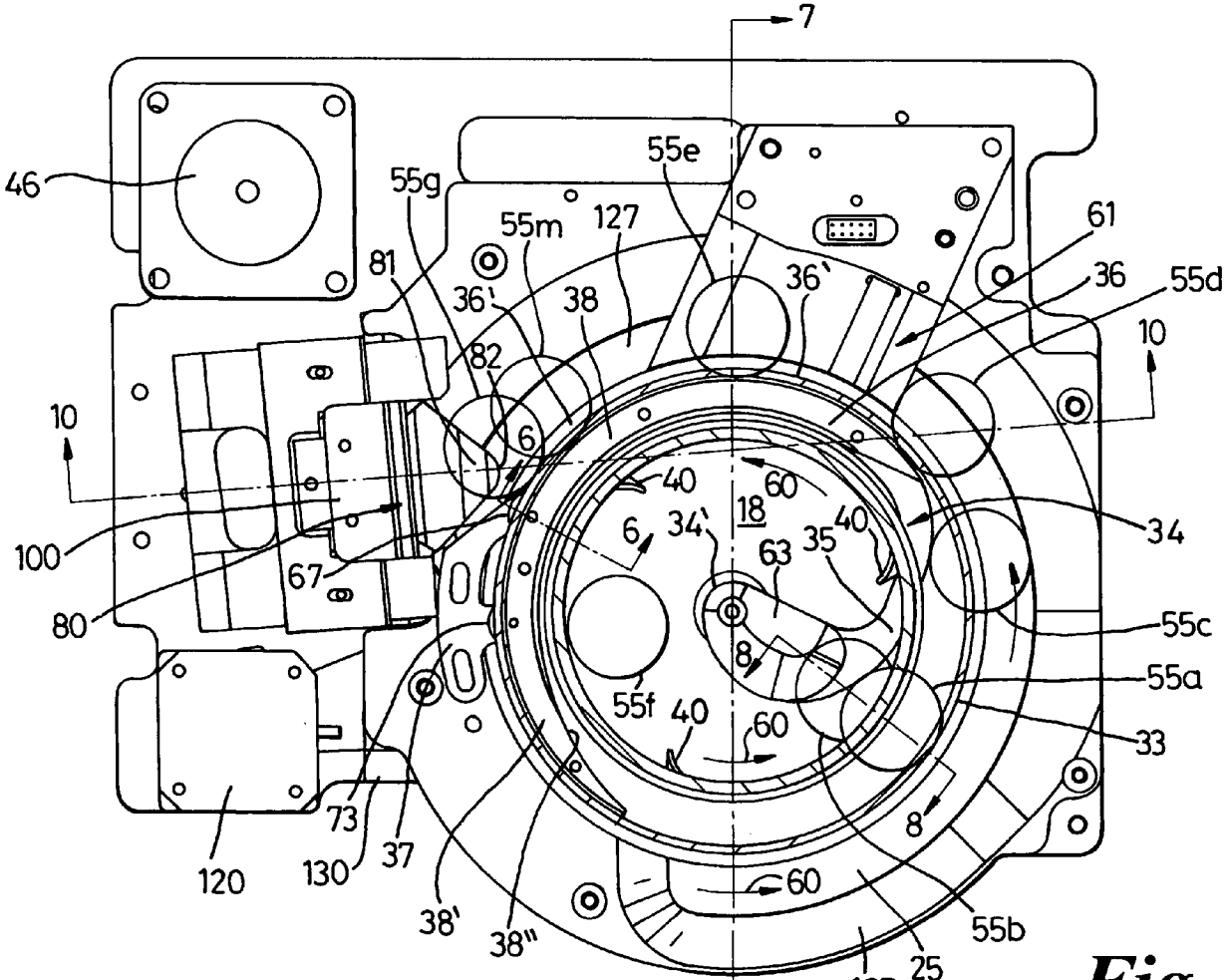
FIG. 4 is a horizontal section taken at the midheight of the resilient hopper on the line 4-4 of FIG. 7.
Figure 5:
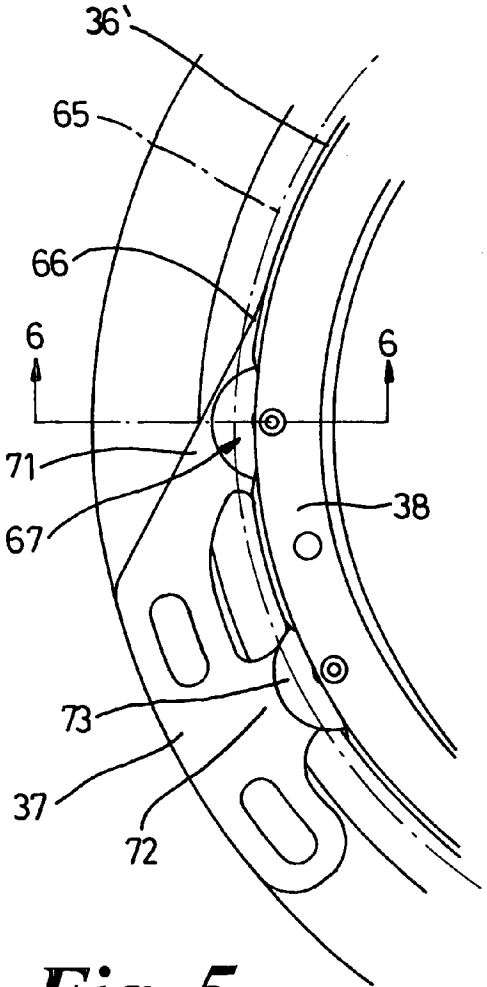
FIG. 5 is an enlargement of part of FIG. 4 showing the support plate for the coin pusher member, and showing the two frusto-conical bearings for carrying the resilient band over the support plate, but with the resilient band and the resilient hopper wall omitted.

As can be seen from FIGS. 4 and 5, the upstream edge 66 of the coin pushing member support plate 37 ultimately diverges radially outwardly from the datum 36, to pass beneath the centre line 65 of band 33, thereby to eject gripped coins from the disc 18 and band 33 when a gripped coin encounters the edge 66, as has just happened to coin 55*g* in FIG. 4.

Figure 9:
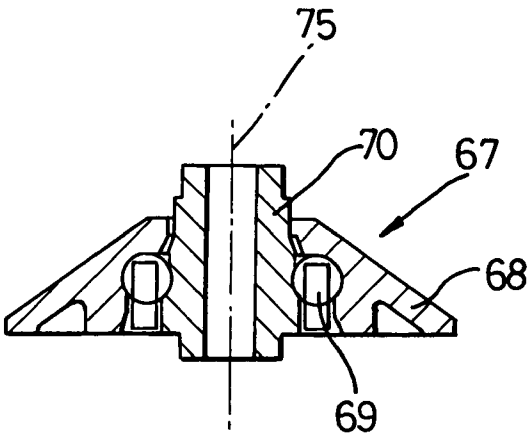
FIG. 9 is an enlarged vertical section through one of the frusto-conical band deflecting bearings of FIG. 5.

A wheel 67, shown more particularly in FIG. 9, is rotatably mounted above the coin pushing member 34. The outer part 68 of the wheel 67 is roughly frusto-conical in shape, the widest part of the frustum being positioned closest to the coin pushing member 34, and is made of a suitable plastics material. A ball race 69 allows the outer part 68 of the wheel 67 to freely rotate around a tubular axle 70.

The wheel 67 is mounted in such a way as to flare the band 33 as it crosses limb 71 of the support plate 37, so that the band 33 does not rub directly on the stationary coin pushing member support plate 37. This is achieved by mounting the wheel 67 within a recess of complementary shape provided in the arcuate block 38 directly above the coin pushing member 34, as shown best in FIG. 6. The axis of rotation 75 of the wheel 67 is mounted radially inwardly, relative to the disc 18, of the centre line 65 of the band 33, such that about half of the wheel extends from the block 38.

Referring to FIG. 6, the band 33 is shown in two positions: an undeflected position, shown in full outline, which is the position the band 33 would assume were the wheel 67 and the coin pushing member 34 not present; and a deflected position in broken outline, showing the actual position of the band 33. The height of the coin pushing member 34 is greater than the distance between the lower margin of the coin band 33 and the disc 18. Therefore in the absence of wheel 67 the band 33 would rub over plate limb 71, potentially creating high friction forces and high wear of the band 33.

The ball race 69 allows the outer part 68 of the wheel 67 to rotate about the wheel axis 75 as the band 33 passes over the limb 71, resulting in relatively low friction on band 33.

Therefore in this arrangement the driving motor 120 for the disc assembly 18, 25 can be smaller than would be required if the wheel 67 were not present, as less force is needed to overcome the reduced frictional forces.

In order to provide firm support for the coin pushing member 34 and arcuate block 38, the support plate 37 is provided with a second support limb 72 spaced circumferentially downstream of the support limb 71, and a second bearing wheel 73, identical to wheel 67, is provided to carry the band 33 over limb 72.

An active coin delivery chute 80 for handling coins, such as coin 55*g* in FIG. 4 being fed by the upper disc 18, will now be described with reference to FIGS. 10 to 12.

The function of the active coin delivery chute 80 is firstly to feed acceptable coins from the disc 18 to the upper disc 6 of the coin storage unit 2, and secondly to direct reject coins from the disc 18 onto the lower disc 25 of the coin feeder, for conveying by the lower disc 25 to the payout cup 12. The manner in which coins received on to the lower disc 25 are conveyed to the payout cup 12 will be described hereafter.

Active chute 80 comprises a reciprocable plate 81 in the form of a curved finger, the upper half of which is of generally triangular shape in plan, as seen in FIG. 4, and with the rounded tip 82 of the finger at the apex of the triangular shape being directed towards the oncoming coin feed constituted by coins such as coin 55*g* in FIG. 4 following the edge 66 of the coin knife 34. The reciprocable plate 81 is spring biased to the raised position shown in FIG. 11 by a coil spring, not shown, and the lower end of plate 81 is bent to define an actuator lug engaged by a bell-crank lever 84 of a solenoid unit 85.

Figure 10:
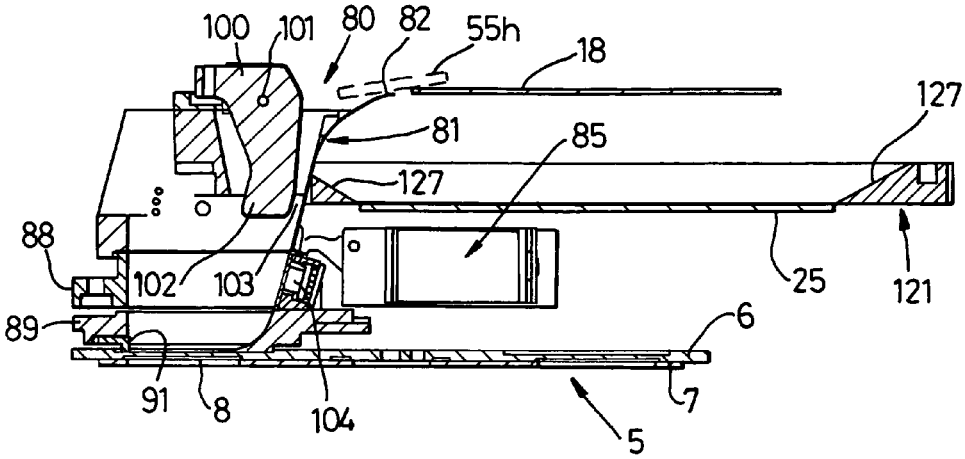
FIG. 10 is a partial cross-sectional view on the line 10-10 of FIG. 4 showing the active coin delivery chute with its curved finger in a coin accepting condition to receive a coin from the upper disc of the coin feeder, and also showing the superimposed adjacent delivery discs of the coin storage unit.
Figure 12:
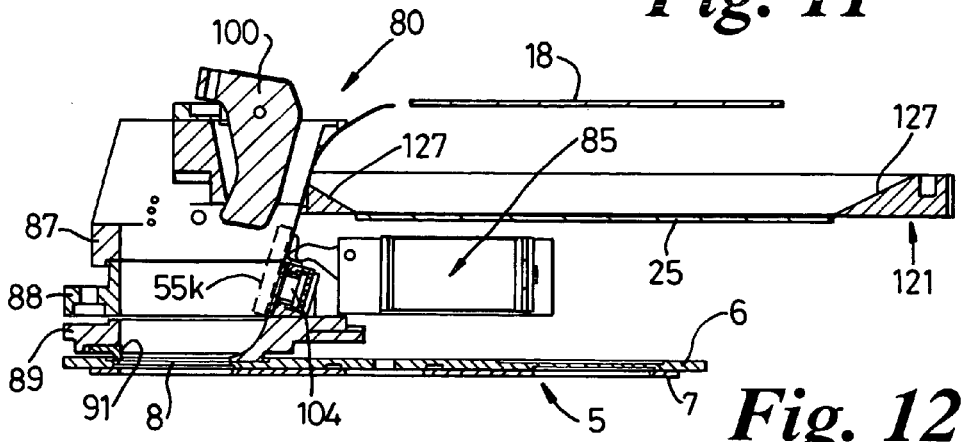
FIG. 12 is a view similar to FIG. 10 showing the pivoted flap of the thickness gauge in a coin-releasing position for releasing an over-thick coin.

As shown in FIGS. 10 and 12 when the solenoid 85 is energised, the plate 81 is brought to a lowered condition in which the finger 82 lies just below, and adjacent to, the upper disc 18. In that raised, default condition of the plate 81, coins, such as 55*h*, in FIG. 10 that have been stripped from the disc 18 by the blade edge 66, FIG. 5, (and have been previously judged to be acceptable by the discriminator module 61) pass over the finger 82, and follow the upper surface of the plate 81 to be directed down into the chute.

Figure 11:
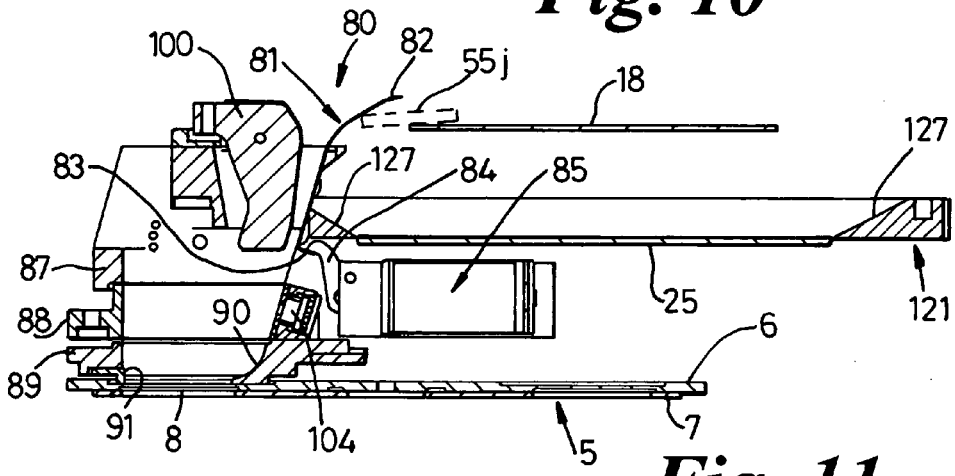
FIG. 11 is a view similar to FIG. 10 with the curved finger of the coin delivery chute in a raised, coin diverting position.

When, on the other hand, it has been determined by the discriminator module 61 that a coin, 55*j* in FIG. 11, is to be rejected, the plate 81 is permitted by de-energisaton of solenoid 85 to be raised to the position shown in FIG. 11 in which the finger 82 is above the level of the upper disc 18, whereby the coin 55*j* is caused to strike the underside of the curved upper part of the plate 81, thereby to be deflected downwards and to come to rest on the upper surface of lower disc 25, sometimes with the assistance of a fixed sloping part-annular wall 127 on a lower disc frame plate 121 to be described hereafter.

With reference to FIG. 11, the lower walls of the active chute 80 are conveniently formed internally of a stack of machined blocks 87, 88, 89, blocks 87 and 88 providing a continuation of the sloping face of the lower portion of the plate 81, whereas the lowest block 89 is formed as a bowl with a curved guide surface 90 which turns a sliding coin received from plate 81 into a substantial horizontal orientation suitable for presentation to the aperture provided in the upper disc 6 of the double disc assembly of the coin storage unit 2.

A snubber 91 carried by the block 89 is formed as an arcuate length of suitable material, such as hardened steel, and of L-section, the snubber 91 being positioned diametrically opposed to the guide wall 90, whereby coins that are directed horizontally by guide wall 90 are arrested by the snubber.

Thus the bottom block 89 is formed as a bowl with guide surface 90 on one side, and snubber 91 on the other side of the bowl, the base of the bowl defining a circular opening in register with the circular dispensing aperture 10, FIG. 2, that leads via chute 11 to the payout cup 12.

A coin thickness gauge is provided by a pivotable restrictor 100 in the form of a block of generally L-shape in vertical cross-section. The restrictor 100 is pivoted about a horizontal axis 101, and is shown in its normal, operative condition in FIGS. 10 and 11 in which the downwardly directed limb 102 of the restrictor 100 defines with the lower portion of the reciprocable plate 81 a gap 103, FIG. 10, of size to permit passage of an acceptable coin of the maximum thickness, but to trap any oversize coins or other items that may have been fed by the upper disc 18.

A coin sensing coil 104 is mounted in block 85 behind the sloping wall thereof for detecting a coin that has been allowed to slide down the chute towards the guide surface 90.

In the event that an oversize coin, that has been accepted by the coin discriminator 61, has become trapped by the restrictor 100, the absence of a coin passing coil 104 will be detected. This can be used by the control system to pivot the restrictor 100 by means of a solenoid, not shown. In FIG. 12 a trapped oversize coin 55*k* has just been released from restrictor 100 by pivoting of the restrictor 100 to the release position shown, and the coin 55*k* is shown passing the coil 104 to provide a signal to confirm that the coin has been released.

When such a trapped oversize coin 55*k* is to be released from the gripping action of the restrictor 100, the disc 6 and 7 of the double disc assembly of the coin storage unit 2, are first brought to the position shown in FIG. 2 in which the apertures in discs 6 and 7 are in register with one another and with the dispensing aperture 10 that leads to chute 11, and then the restrictor 100 is pivoted to the release position shown in FIG. 12.

The manner in which reject coins and any other debris received on lower disc 25 are handled will now be described, with particular reference to FIG. 13.

The coin take-off means for the lower disc is constituted by a coin deflecting face 123 on an arm 124 which is an integral portion of lower disc frame plate 121, and which is directed generally radially inwardly of the disc 25, but inclined at an acute angle to a radius thereof. The lower face of arm 124 is closely spaced from the upper surface of disc 25 to ensure that substantially all material, ie coins, fluff, buttons and other debris, cannot pass under arm 124 but instead are deflected off the upper surface of disc 25 by the deflecting face 123.

Figure 13:
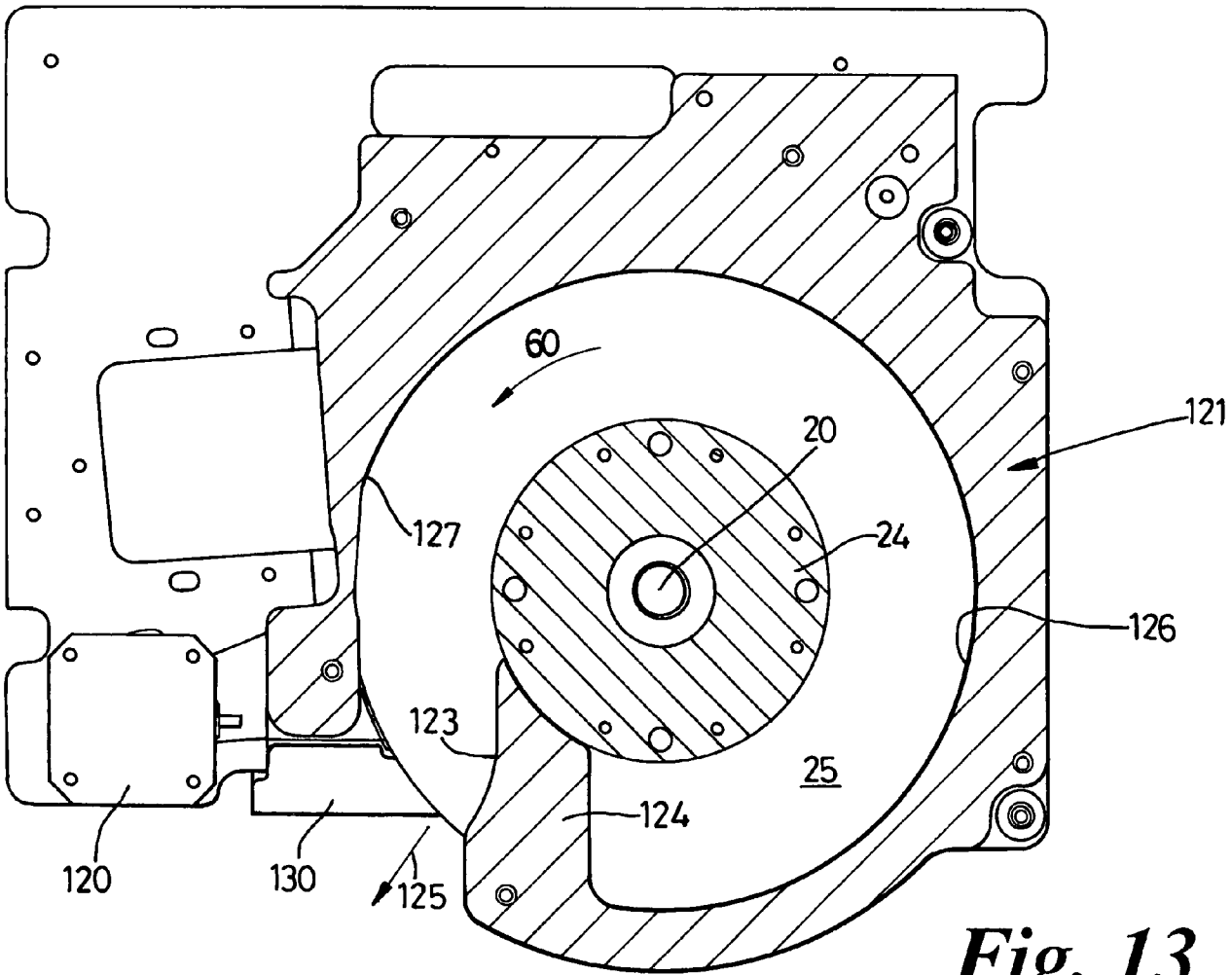
FIG. 13 is a partial horizontal cross-section on the line 13-13 of FIG. 7 to show the coin take-off means for the lower disc of the coin feeder.

As shown in FIG. 13, the deflecting face 123 is substantially concave in plan, as encountered by coins moving in the direction of rotation 60 of the disc 25, so as to direct coins and debris off the disc in the direction of arrow 125.

Figure 3:
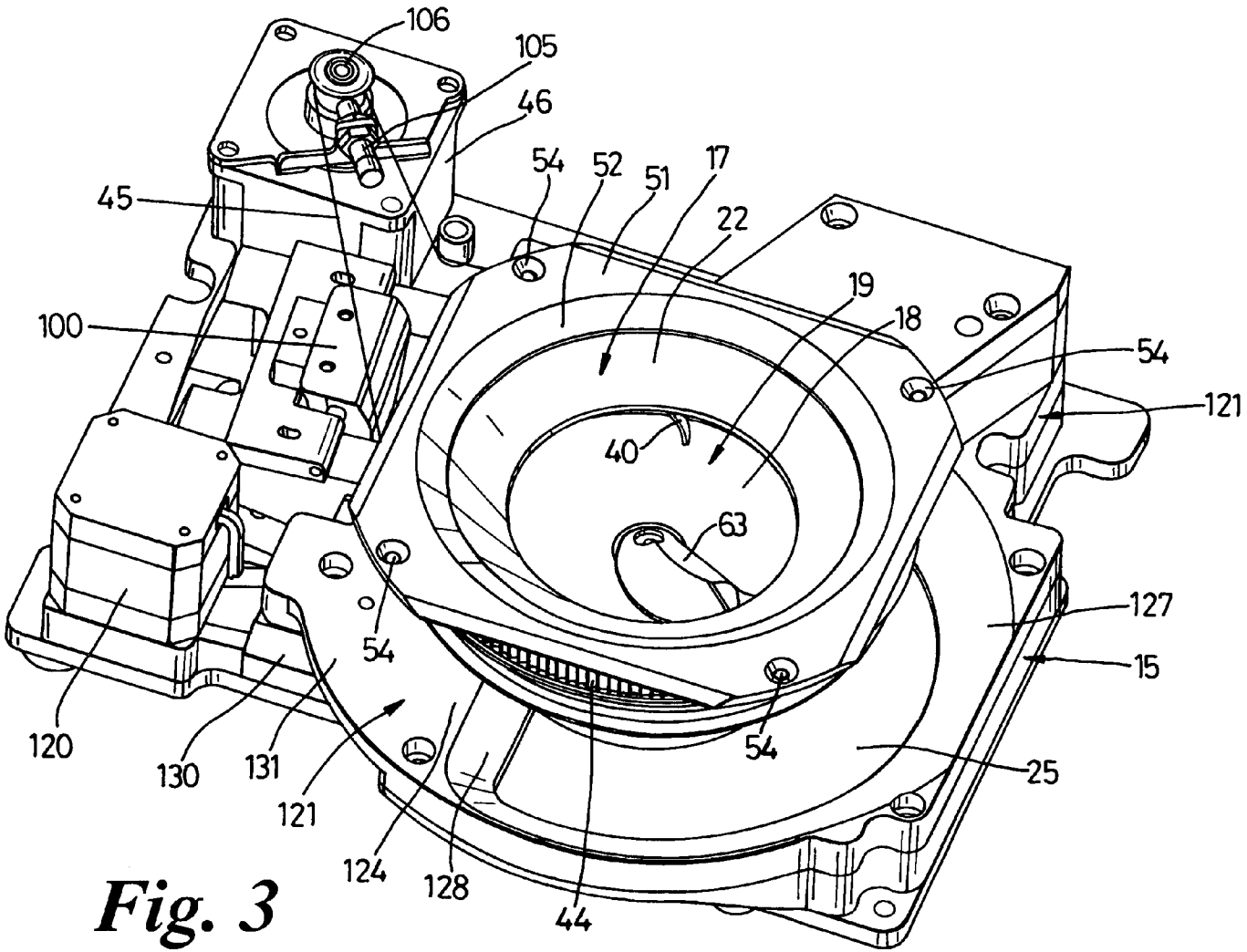
FIG. 3 is a view on a larger scale of the hopper coin feeder but with the top plate removed to show the drive motor for rotating the resilient hopper wall, and to show the entrance to the active coin delivery chute leading to the delivery discs of the coin storage unit, the path of the belt drive to the hopper wall being indicated as a line.
Figure 7:
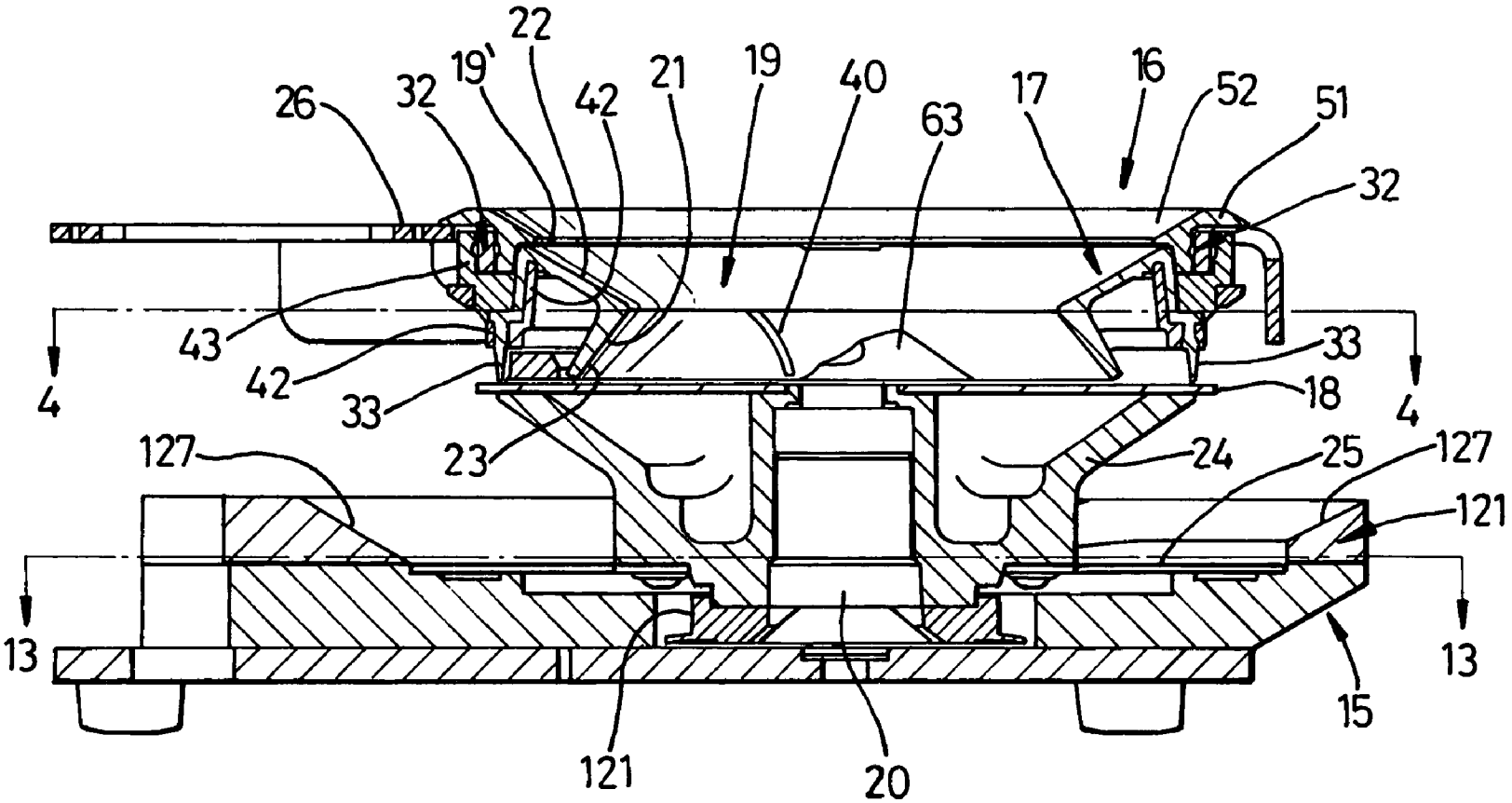
FIG. 7 is a vertical section taken on the line 7-7 on FIG. 4.

As seen in FIGS. 3 and 7 and 13, frame plate 121 is provided with a substantially circular through-aperture defined by part-circular edge 126, apart from the presence of said arm 124, in which the lower disc 25 rotates with slight clearance, and the upper surface of the frame plate 121 is chamfered to provide a sloping border 127. The sloping border 127 performs the function of directing all coins or debris that fall from the edge of the upper disc 18 onto the lower disc 25. As can be discerned from FIG. 4, the sloping border 127 essentially extends circumferentially about the disc 25 from the region of the tail 381 of the arcuate guide block 38 to the active chute 80, that is circumferentially in FIG. 13 from the arm 124 to the point 127 in that Figure. The arm 124 is also provided with a chamfered trailing edge 128, FIG. 3, for the same reason. Since all gripped coins that have been carried round with the upper disc 18 and have travelled as far as the active chute 80 will either be diverted by the active chute downwards onto the lower disc 25, or be directed into the chute, and in view of the presence of the arcuate guide block 38, there is no possibility of coins leaving the edge of the upper disc 18 in the arcuate region between the active chute 80 and the arm 124.

Since anything that falls form the upper disc 18 is captured on the lower disc 25 and is removed by the coin deflecting face 123, this provides an extremely efficient means of ensuring that excess items are returned to the user. Of course, the provision of a second, lower disc in a hopper coin disc feeder does inevitably lead to an increase in overall height of the disc feeder, but the advantages achieved in accounting for all coins inserted into the hopper outweigh this penalty, even in the context of the assembly of FIG. 1 where the height of the hopper feeder assembly 1 was required to be kept to a minimum.

Since a hopper coin feeder in which the coins are gripped between a resilient band and a coin disc face has the advantage that both sides of the coin are accessible to the coin discriminator, it is envisaged that the hopper feeder of FIG. 1, even when used without the active chute 80, will have many other uses for handling coins.

Coins and other items that are directed off the disc 25 by the coin deflecting face 123 of arm 124, and proceed in the direction of arrow 125 in FIG. 13 will fall onto the downwardly sloping face 130 on the chassis 15, best seen in FIGS. 2, 3 and 13. As best seen in FIGS. 2 and 3, a bridge portion 131 of the plate 121 extends over the sloping surface 130 and permits coins to leave the disc by passing under the bridge portion 131.

With reference to FIG. 2, any such coins or debris that leave the lower disc 25 are diverted by sloping face 130 into a reject chute 132 carried by the coin storage unit 2, to fall via chute 11 into the payout cup 12.

The overall control of the feeder unit 1 and coin storage unit 2 will now be outlined.

As previously mentioned, the drive motors 46 and 120 are driven by a common pulse source, and the pulses are used in conjunction with the output of the coin discriminator unit 61 to synchronise the operation of the active coin chute 80. Coin discriminator unit 61 responds to the presence of a gripped coin ie gripped between band 33 and upper disc 18, being conveyed through the discriminator unit 61. By counting pulses of the pulse source 105 the precise position of the gripped coin is tracked as the disc 18 is rotated to carry the gripped coin towards the coin take-off position determined by the edge 66, FIG. 5, of the support plate 37.

The upper disc 18 is indexed to bring a coin to a holding position, shown by coin 55*m* in FIG. 4, just in advance of the point of divergence of the edge 66 from the arcuate datum 36$^1$, that is just in advance of the tip 82 of the reciprocable plate 81. On receipt of a demand signal from the coin storage unit 2 that indicates that the double disc assembly 5 is ready to receive a coin, the motor 46 is driven, with the active chute energised to the condition of FIG. 10, to allow the coin, now shown as 55*h* in FIG. 10 to pass down into the chute 80. Coil 104 will provide a confirmatory signal of the delivery of a coin to the double discs 6, 7 as the coin passes down chute 80, providing that the coin was not found to be oversize, and consequently held by the pivoted restrictor 100.

Once a coin has been fed into the chute 80, by indexing of the disc 18 by a predetermined amount from the holding position 55*m*, FIG. 4, the disc 18 will be indexed by the appropriate amount to bring the next coin in line that has been measured by the discriminator unit 61 into the holding position.

An encoder 105, FIG. 3, is responsive to the teeth on the drive pulley 106 of pulse driven motor 46 to detect a jam. The presence of a jam, and other information and data, can be displayed on an LCD display panel 140 mounted on plate 26.

In the event that the discriminator unit 61 has determined that the next coin approaching the holding position 55*m* is to be rejected, then the disc 18 will be driven to feed the coin onto the lower disc 25 by arranging for the solenoid 85 to be de-energised such that the plate 81 is in the raised position of FIG. 11, and then the disc 18 will be driven to bring the next coin in line to the holding position where it is held (providing that this coin is an acceptable coin).

The invention claimed is:

1. A hopper coin feeder of the horizontal disc type comprising a circular resilient hopper wall defining with a horizontal disc, a hopper space for receiving coins and providing the principal coin holding zone of the hopper feeder, the disc and the hopper wall being arranged in use to rotate relative to a machine chassis, the resilient hopper wall having a lower edge which is closely adjacent to, or in light contact with, the upper face of the horizontal disc when the hopper wall is not flexed, and a stationary coin pushing member extending generally radially inwardly from adjacent the edge of the horizontal disc, beneath said lower edge into said hopper space, the hopper coin feeder being so arranged that, in use, a coin input to the hopper space is carried on the rotating horizontal disc, and on contact with the coin pushing member is urged radially outwardly beneath the lower edge of the resilient hopper wall, the hopper wall flexing in order to allow the coin to pass, the hopper coin feeder further comprising a resilient band that confronts the margin of the upper face of the disc, is external to the lower edge of the hopper wall, and is driven around with the disc, the arrangement being such that coins fed to the band by said coin pushing member are then carried around with the disc, gripped between the band and the disc but projecting radially outwards from the band.

2. A hopper coin feeder as claimed in claim 1 in which the hopper wall comprises frusto-conical upper and lower parts, the lower part expanding downwardly, so as to define an angle with the horizontal disc that is less than 90 degrees, as viewed internally of the hopper.

3. A hopper coin feeder as claimed in claim 2 in which the lower part of the hopper wall is formed with one or more vanes that project into said hopper space.

4. A hopper coin feeder as claimed in claim 2 for feeding coins including coins of a minimum specified thickness, and wherein the coin pushing member is no thicker than the height of said minimum specified thickness.

5. A hopper coin feeder as claimed in claim 4 in which the coin pushing member is of a height less than said minimum specified thickness.

6. A hopper coin feeder as claimed in claim 1 in which the coin pushing member is arcuate in plan, and defines a curve which is substantially convex as presented to the approaching coins on the disc.

7. A hopper coin feeder as claimed in claim 5 in which the coin pushing member extends substantially to the centre of the disc, and a radially inner portion of the coin pushing member is covered by a faired cap.

8. A hopper coin feeder as claimed in claim 2 in which the frusto-conical upper part of the resilient hopper wall expands upwardly, whereby the hopper wall is in the form of a diabolo or concertina.

9. A hopper coin feeder as claimed in claim 1 in which the hopper wall and the band are supported by a bearing assembly carried by a horizontal hopper-bearing support plate.

10. A hopper coin feeder as claimed in claim 9 in which the hopper wall and the band are formed as an integral moulding that has been overmoulded onto a carrier ring.

11. A hopper coin feeder as claimed in claim 9 in which the hopper-bearing support plate is pivotally connected to the chassis to enable the hopper wall and band to be swung away from the disc.

12. A hopper coin feeder as claimed in claim 1 wherein separate stepper motors are provided for the disc and band and hopper wall, but arranged to be driven in synchronism by a common pulse source.

13. A hopper coin feeder as claimed in claim 1 in which the coin pushing member is supported from a point radially outwards of the edge of the horizontal disc, by a support plate extending beneath the band.

14. A hopper coin feeder as claimed in claim 13 in which the radially inner end of the coin pushing member is secured to a post on which the disc is journalled.

15. A hopper coin feeder as claimed in claim 13 comprising a band deflecting bearing located where the support plate extends beneath the band, the bearing being adapted in use to deflect the band in such a way that the band substantially does not rub directly on the support plate.

16. A hopper coin feeder as claimed in claim 15 in which the band deflecting bearing is a wheel rotatably mounted above the support plate.

17. A hopper coin feeder as claimed in claim 16 in which the band deflecting wheel is substantially frusto-conical, with the base of the frustum being adjacent the support plate, and so arranged that the band is locally flared by the wheel to deflect the lower margin of the band upwardly and radially outwardly, relative to the disc axis, over the support plate.

18. A hopper coin feeder as claimed in claim 17 in which the axis of rotation of the wheel is located radially inwardly, relative to the disc axis, of a centre line of the band.

19. A hopper coin feeder as claimed in claim 16 in which the support plate comprises two circumferentially-spaced limbs that extend beneath the band, both limbs being associated with respective band deflecting bearings.

20. A hopper coin feeder as claimed in claim 14 in which the support plate is provided with a coin take-off edge that is so configured as in use to engage a coin gripped between the band and the disc, and to take off said coin from the disc.

21. A hopper coin feeder as claimed in claim 20 in which the coin take-off face of the support plate is spaced circumferentially of the disc path from the outer end of the coin pushing member in order to accommodate a coin discriminator which is arranged to examine the coins as they are carried past the discriminator with one edge of the coin gripped between the band and the outer margin of the disc.

22. A hopper coin feeder as claimed in claim 14 in which an arcuate guide block is secured to the radially outer end of the coin pushing member and to the radially inner part of the support plate, the radially outer face of the guide block providing a guide face for the gripped edges of the coins.

23. A hopper coin feeder as claimed in claim 1 comprising an additional rotatable horizontal disc positioned below the main disc.

24. A hopper coin feeder as claimed in claim 23 in which the upper disc and the lower disc are connected together by a hub for driving with a common drive motor.

25. A hopper coin feeder as claimed in claim 24 in which the lower disc is bordered by a bowl wall to deflect any item falling from the upper disc onto the lower disc.

26. A hopper coin feeder as claimed in claim 23 comprising take-off means so arranged as to return items received on the lower disc to a payout cup for return to a user.

* * * * *